United States Patent [19]

Becker et al.

[11] 4,316,759

[45] Feb. 23, 1982

[54] HAND APPLIANCE FOR ISSUING OR APPLYING SELF-ADHERING LABELS

[75] Inventors: Werner Becker, Hirschhorn; Richard Schwobel, Rothenberg, both of Fed. Rep. of Germany

[73] Assignee: Esselte Pendaflex Corporation, Garden City, N.Y.

[21] Appl. No.: 123,579

[22] Filed: Feb. 22, 1980

[30] Foreign Application Priority Data

Feb. 22, 1979 [DE] Fed. Rep. of Germany ..... 2906856

[51] Int. Cl.[3] ..... B44C 7/00; B44C 7/04; B65H 49/26; B65H 17/02

[52] U.S. Cl. ..... 156/387; 156/277; 156/540; 156/542; 156/DIG. 33; 156/384; 156/DIG. 37; 156/DIG. 49; 156/577; 242/67.3 R; 242/35; 242/35.5 A

[58] Field of Search ..... 156/540, 541, 584, 277, 156/384, 387, 542, 577, DIG. 28, DIG. 33, DIG. 37, DIG. 49; 74/126, 128; 242/68.3, 68.4, 54 R, 35 A, 67.3 R, 55.53; 192/26, 12 BA

[56] References Cited

U.S. PATENT DOCUMENTS

| | | | |
|---|---|---|---|
| 1,811,028 | 6/1931 | Ryan | 192/26 |
| 2,005,822 | 6/1935 | Burrell | 74/128 |
| 3,232,399 | 2/1966 | Harned et al. | 192/12 BA |
| 3,529,703 | 9/1970 | Kroeker | 192/26 |
| 4,053,345 | 10/1977 | Hamisch, Jr. | 156/541 |
| 4,109,552 | 8/1978 | Imoberdorf | 74/128 |
| 4,116,401 | 9/1978 | Evert et al. | 242/68.3 |

*Primary Examiner*—Edward C. Kimlin
*Assistant Examiner*—L. Falasco
*Attorney, Agent, or Firm*—Gerald J. Ferguson, Jr.; Joseph J. Baker

[57] ABSTRACT

A hand appliance for issuing or applying self-adhering labels which are stuck on a carrier strip is disclosed. The appliance has a feeding mechanism which withdraws the carrier strip to feed one label at a time. The feeding mechanism has a winding core on to which the carrier strip is wound and which is rotatable about a journal fixed at one end to a housing wall. The winding core is held for axial displacement on a boss which drives the winding core by means of a projection engaging a groove extending obliquely of a surface line of the boss such that the boss shifts the winding core under the tension of the carrier strip in the direction of the wall of the housing on which the journal is fixed to thereby maintain said winding core within the appliance when in operation and facilitate its removal when desired.

19 Claims, 6 Drawing Figures

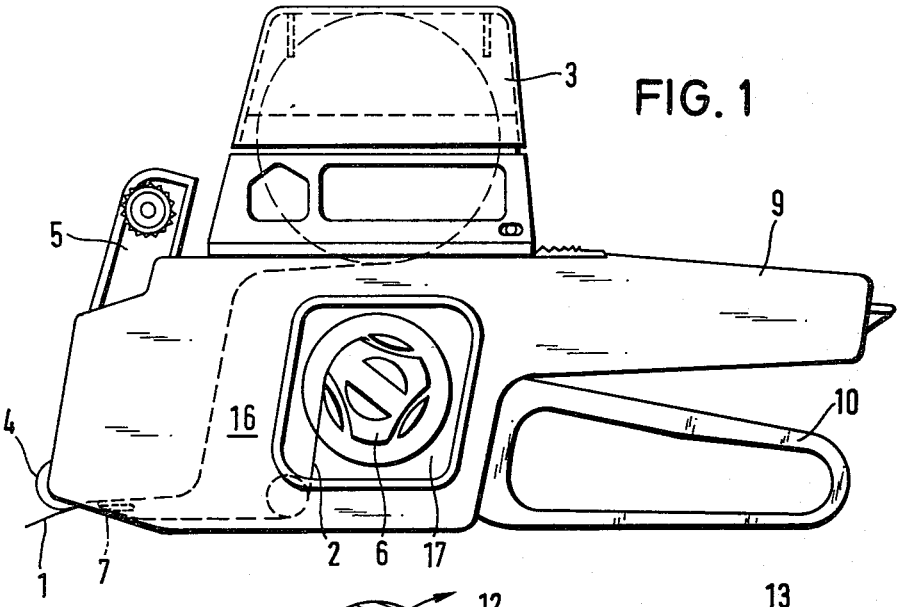
FIG. 1
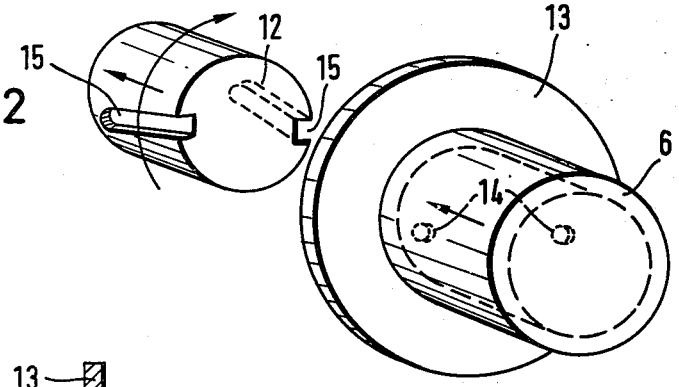
FIG. 2
FIG. 3
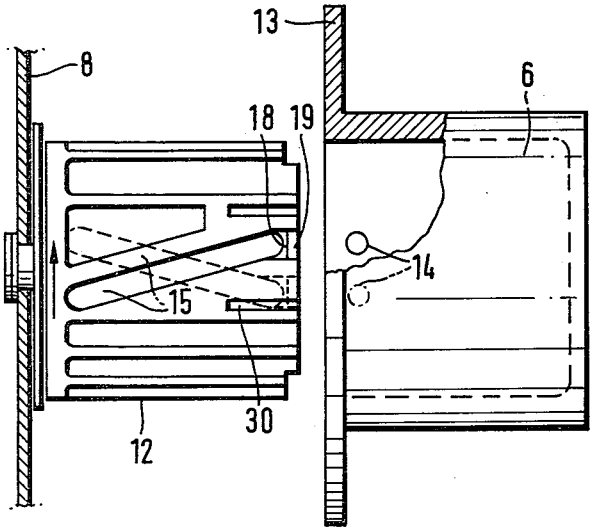
FIG. 4
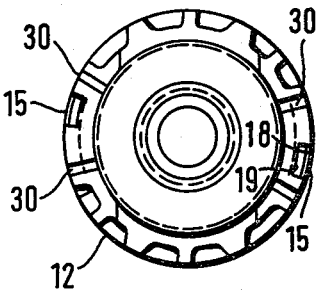

FIG. 5
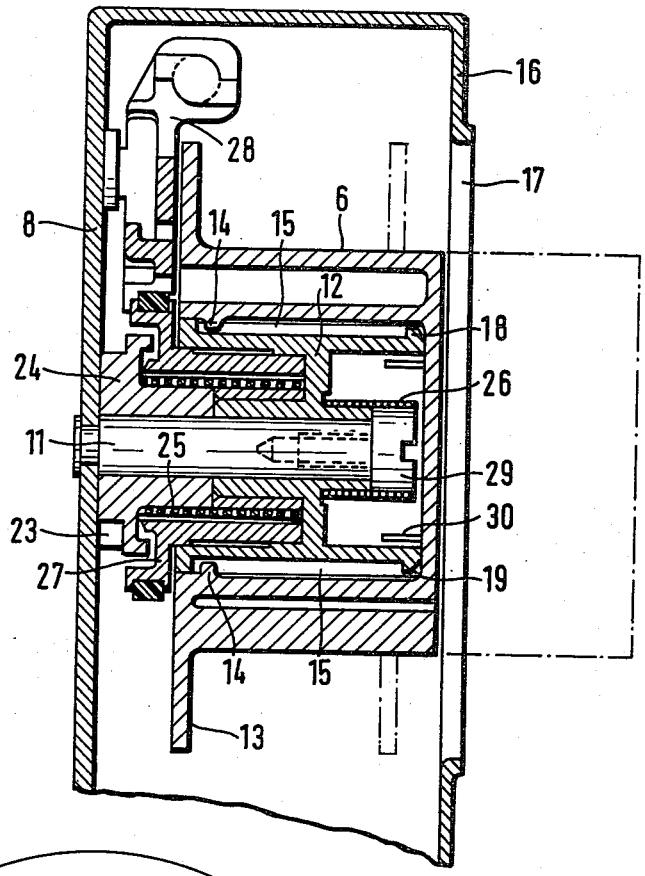
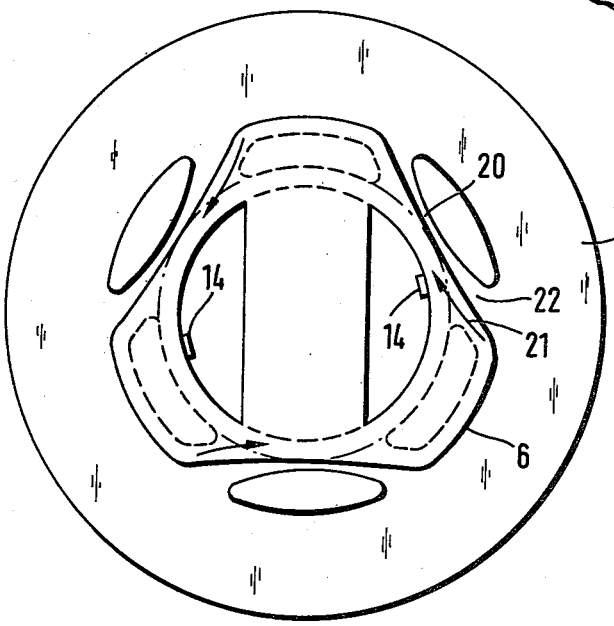
FIG. 6

HAND APPLIANCE FOR ISSUING OR APPLYING SELF-ADHERING LABELS

REFERENCE TO RELATED APPLICATION

This application is related to U.S. application Ser. No. 11,644, filed Feb. 12, 1979, by Werner Becker and Gunter Holland-Letz.

BACKGROUND OF THE INVENTION

The invention relates to a hand appliance for issuing or applying self-adhering labels which are attached to a carrier strip. The appliance is equipped with a feeding mechanism which withdraws the carrier strip stepwise for feeding one label only. The mechanism comprises a winding core on which the carrier strip is wound and which is rotatable about a journal fixed at one end on a housing wall.

A manually operated labelling appliance of this type is known from U.S. Pat. No. 4,053,345. With the known hand appliance, the winding core is mounted in a housing open at one end, which housing can be connected to a labelling appliance. The winding core is driven through a friction disc such that the carrier strip to be wound on is held under tension by the winding core. The friction wheel drive serves as a slipping clutch when the feeding of the label strip is completed, but the winding core is still driven by the friction disc or wheel.

The known appliance has the disadvantage that it is inconvenient to remove the wound-on carrier strip from the winding core. Due to the fact that the housing of the winding or coiling arrangement is not much larger than the coil of strip which is to be wound on it, it is difficult to grip the end of the strip in order to remove the wound carrier strip from the winding core.

SUMMARY OF THE INVENTION

It is the object of the invention to design a hand appliance of the type as initially referred to such that the removal of the wound-on carrier strip is facilitated, also when the winding core is arranged inside the housing of a labelling appliance. This object is achieved according to the invention by the winding core being held so that it can be displaced axially on a hub or boss which drives the winding core and is so coupled to the boss through a driving projection, which engages in a groove extending obliquely of a surface line of the boss, that the driving boss pushes the winding core, under the tension of the carrier strip, in the direction towards the housing wall on which the journal is fixed.

With the hand appliance according to the invention, it is possible, on completing the winding operation, for the winding core to be withdrawn without any difficulty from the boss and for the carrier strip to be removed.

The driving projection can be arranged on the peripheral surface of the boss, while the obliquely extending groove may be arranged on the internal surface of a winding core constructed in the form of a drum. In this case, the groove, seen from the free end of the journal, extends obliquely forwards in the winding direction.

As a kinematic inversion, however, the driving projection may also be arranged on the inside surface of the winding core, while the groove is formed in the peripheral surface of the boss. In this case, the groove extends, as seen from the free end of the journal, obliquely in a rearward direction, i.e. opposite to the winding direction.

The strip tension exerted by the carrier strip to be wound on to the winding core has the effect of always maintaining the core in the correct position inside the appliance.

However, if the carrier strip is so wound on that no strip tension is any longer able to have an effect on the winding core, then the core may be shifted axially towards the free end of the journal and can be removed from the appliance.

The groove preferably extends at an angle of between 10° to 30°, but advantageously at an angle of 15°, obliquely in respect of a surface line of the boss.

It is proposed in a further development of the invention for a stop or abutment to be arranged on that end of the groove which is fartherest from the housing wall on which the journal is secured. The effect produced by this abutment is that the axially displaceable winding core cannot be removed from the boss, but broadly may be extracted from the housing. What is hereby prevented is the removal of the winding core or the winding drum from the appliance and thus being mislaid.

In that position of the winding core in which it projects from the appliance, the wound-on carrier strip may be unwound without any effort—like a paper or air streamer—from the winding core, for example, by the labelling appliance being held over a waste-paper basket with the winding core directed downwardly.

Other features of the invention become apparent from the claims.

BRIEF DESCRIPTION OF THE DRAWINGS

More fully explained in the following description is one constructional example of a manually operable labelling appliance according to the invention, by reference to the drawings, wherein:

FIG. 1 is a side elevation of a labelling appliance with the winding arrangement according to the invention for the carrier strip of the labels, FIG. 2 is a perspective view of the winding core and of the boss which drives the core, FIG. 3 is a front view of the driving boss and of the winding core, FIG. 4 is a side elevation of the driving boss, FIG. 5 is a sectional view of the winding core, the boss and the driving parts, FIG. 6 is a side elevation of the winding core.

DESCRIPTION OF THE PREFERRED EMBODIMENT

The appliance which is shown in FIG. 1 uses self-adhering labels 1, which are attached in succession to a carrier strip 2, during their travel from the label-supply reel which is arranged in the container 3 to the label-issuing position, at which is arranged a pressure-applying roller 4. The labels 1 are printed by a printing unit 5 and the carrier strip 2 is pulled step-by-step around a deflecting device 7 for detaching the labels 1 from a winding core 6 which is rotated intermittently. At the deflecting device 7, the carrier strip 2 is deflected through an arc of approximately 180°, so that the self-adhering labels, because of their stiffness, are detached from the carrier strip and pass into the dispensing position. A printed label 1, which is for the major part detached from the carrier strip 2 and is disposed in the dispensing position, is then capable of being applied by means of the pressure-applying roller 4 or another pressure-applying device to an object or article which is to be labelled.

Those parts of the appliance which are necessary for printing the labels and also for the intermittent feeding of the labels are arranged in a housing, which comprises a handle 9, towards which a hand lever 10 can be pivoted against the force of a return spring. By the inward swinging movement of the hand lever 10, the printing unit 5 is moved towards a printing bed. With the reverse swinging movement of the hand lever 10, the winding core 6 is rotated through a certain angle in the withdrawal direction, for example, by way of a rack, which meshes with a pinion, and by way of a free-wheel clutch.

The drum-like winding core 6 is rotatable about a journal 11 which is fixed at one end on one wall 8 of the housing. As shown more particularly in FIG. 5, a boss 12 for driving the winding core 6 is mounted on the journal 11, and on the boss 12 the winding core 6 is held so as to be displaceable axially.

As shown in FIGS. 2, 3 and 6, the winding core 6 is so coupled with the hub or boss 12, through two driver projections 14 and two grooves 15 which extend obliquely of a surface line of the boss 12 or, respectively, obliquely of the axis of rotation of the boss 12 that the driving boss 15 displaces the winding core 6 under the tension of the carrier strip 2 in the direction towards the wall 8 of the housing on which the journal 11 is fixed. The obliquely extending grooves 15, in conjunction with the tension of the carrier strip 2 which is to be wound on, thus act to insure that the winding core or the winding drum 6 is always held inside the housing.

The grooves 15 extend at an angle of 15° obliquely of those surface lines of the boss 12 which extend parallel to the axis of rotation, and in fact, as seen from the free end of the journal 11, obliquely opposite to the winding direction. To prevent the winding core 6 from being withdrawn from the boss 12, that end of the groove 15 facing the free end of the journal 11 is closed off by a stop member 18. The outwardly facing surface of the stop member 18 is bevelled, so that a feed-in bevelled surface 19 is formed, which makes it possible for the winding core 6 to be pushed on, with elastic deformation of the core 6 and/or of the boss 12.

As shown in FIGS. 3 and 4, slots 30 are provided on both sides of the stop members 19, so that the outwardly facing ends of the grooves 15 are disposed on resilient tongues. The tongues are forced radially inward by, for example, 1 to 2 mm, when the winding drum 6 is pushed with its driver projections 14 on to the boss 12.

As shown in FIGS. 1 and 5, for the convenient unwinding of the coil of the carrier strip 2, a relatively large opening 17 is arranged in that wall 16 of the housing which faces the housing wall 8, it being possible for the winding drum 6 to be extracted from the housing through the opening 17. When the end of the carrier strip 2 has passed beyond the deflecting device 7, or respectively when no tensile force or tension is any longer acting on the carrier strip 2, the winding core 6 can be displaced to the free end of the journal 11 until the driver projections 14 abut against the stop members 18. In this position, the major part of the winding core 6 projects from the housing, as is shown in broken lines in FIG. 6. In this position of the winding core 6, it becomes possible, by holding the labelling appliance at an angle, for the wound carrier strip 2 to be uncoiled automatically—similar to a streamer—for example into a waste-paper basket.

As shown in FIG. 6, the winding drum 6 is formed with insertion slits 20, into which the leading end of the carrier strip 2 can be fitted. The leading end of the strip 2 is inserted into the slits 20 to such an extent, opposite to the take-up direction, that the leading zone of the first turn already bears on the inserted leading end of the strip and clamps the end between it and the drum 6. For easy introduction of the leading end of the carrier strip 2, the slits 20 are broadened on the insertion side to form entry funnels 22.

Arrows 21, which are arranged on the outwardly disposed wall of the winding core 6, indicate the direction of insertion.

With this labelling appliance, the angle of rotation of the winding core 6 is so controlled that, with each feeding or advancing movement, one label is brought into and exactly maintained in a dispensing position and possibly another label is brought into and exactly maintained in a printing position. Label strips are used which, for controlling the feeding mechanism, are provided with marginal notches, incisions or recesses, arranged at intervals which correspond exactly to the spacing between the leading edges of the labels. The recesses are scanned mechanically by means of feeler members or projections. The feelers or projections which engage in the recesses control the withdrawal or take-off travel of the winding drum 6 in such a way that the drive of the drum 6 is interrupted by a controllable clutch as soon as the label being brought into the dispensing position has reached its predetermined position.

Because the coil diameter changes with the number of turns of carrier strip 2 which are wound on it, the angle of rotation of the winding drum 6 has to be smaller as the diameter of the already wound-on strip coil is larger. For this reason, the coupling phase of the freewheel clutch is controlled in dependence on the spacings with which the labels 1 stick to the carrier strip 2. The coupling of the pinion 23 with the winding drum 6 can take place when the printing unit 5, by inward pivoting of the hand lever 10, is swung against the printing bed, or even when the printing unit 5 and the hand lever 10 are swung by the return spring into the initial position.

As shown in FIG. 5, the pinion 23 is constructed as a toothed segment and is arranged on a driving boss 24, which is mounted on the journal 11 on which is also mounted the boss 12. The boss 12 carries the winding drum 6 and is coupled to the drum through driver projections 14, which engage in the obliquely extending grooves 15 of the boss 12. The journal 11, which is fixed on the housing wall 8, the driving boss 24, the driven boss 12, the controllable freewheel clutch which is formed by a coil spring 25, the reversing lock which is also formed by a coil spring 26, and a control cage 27, are mainly arranged inside the winding drum 6.

A control latch or pawl 28 is operative in such a manner on the control cage 27 that, with rotation of the driving boss 24 and of the coiled spring 25 connected thereto in the driving direction, the coil spring 25 is loaded and as a consequence becomes smaller in diameter and immediately produces a coupling with the boss 12. If the control latch or pawl 28 is lifted from the control cage 27, the coil spring is then detensioned in such a manner that its diameter becomes larger and the coupling between driving boss 24 and boss 12 is broken. The coil spring 25 then only produces a coupling between the driving boss 24 and the boss 12 when the driving boss 24 is rotated in the driving direction.

For the purpose of simplifying the drawing and for a better view the obliquely extending groove 15 is shown folded into the plain surface of the drawing in FIG. 5.

What is claimed is:

1. A hand appliance for issuing or applying self-adhering labels which are stuck on a carrier strip, the appliance is equipped with a feeding mechanism which withdraws said carrier strip stepwise for feeding at least one label at a time, said feeding mechanism having a winding core on to which said carrier strip is to be wound and which is rotatable about a journal fixed at one end to a housing wall, the improvement wherein said winding core is held for axial displacement on a boss which drives said winding core and, said winding core through a driver projection which engages in a groove extending obliquely of a surface line of said boss, is so coupled to said boss that said boss shifts said winding core, under the tension of said carrier strip, in the direction of said wall of said housing on which said journal is fixed wherein said groove extends at an angle of from 10° to 30° obliquely of said surface line of said boss.

2. A hand appliance according to claim 1 wherein said groove is in the external surface of said boss and said driver projection engaging said groove is arranged on the inside wall of said winding core.

3. A hand appliance according to one of claims 1 or 2, wherein said boss has two grooves opposite one another and said winding core has two driver projections engaging said grooves.

4. A hand appliance according to claim 1 wherein a stop member is arranged at that end of said groove which is further from said housing wall on which said journal is secured.

5. A hand appliance according to claim 4 wherein said stop member is arranged on a region of said boss which has a radially inward springing action.

6. A hand appliance according to claim 5 wherein said stop member comprises an insertion bevel on the side thereof which is axially external.

7. A hand appliance according to claim 1 wherein said winding core is constructed in the form of a drum and is held on said boss, said winding core being capable of being driven by another driving boss through a controlled freewheel clutch which is rotated through angles of rotation corresponding to the spacings of said labels.

8. A hand appliance according to claim 7 wherein said freewheel clutch comprises a coil spring which is arranged on said other driving boss and is wrapped around a cylindrical part of said boss of said winding drum, the free end of said spring being connected to a control cage.

9. A hand appliance according to claims 6 or 7 wherein said journal, said controllable freewheel clutch, and said reversing lock are mainly arranged inside the boss of said winding drum.

10. A hand-held labeller for issuing or applying self-adhesive labels which adhere as a strip or separately at equal distances on a carrier strip, said labeller comprising a housing having first and second facing housing walls where the first of said walls has an opening disposed therein;

a driving boss rotatably mounted with respect to the second wall adjacent the opening in the first wall;

a feed wheel mounted by and axially shiftable with respect to the driving boss between a first position adjacent the second wall and a second position where the feed wheel at least partially extends through the opening in the first wall;

a supply member mounted with respect to said housing for mounting said carrier strip and labels;

a label separation member mounted with respect to said housing;

means for guiding said carrier strip from said supply member by said label separation member and then to said feed wheel so that the carrier strip is under tension; and a hand lever so pivotally mounted with respect to said housing that the lever may be pivoted by an operator's hand as the labeller is being held in the hand of an operator;

coupling means for coupling said hand lever to said feed wheel via the driving boss to operate the feed wheel each time the hand lever is pivoted and thus advance the carrier strip from the supply member so that the labels are successively separated from the carrier strip at the label separation member and the carrier strip is incrementally wound upon the feed wheel;

whereby said feed wheel may be shifted to its second position through the opening in the first wall to facilitate the removal of carrier strip wound thereon.

11. A labeller as in claim 10 including connecting means for maintaining the feed wheel in said first position as long as the carrier strip is under said tension and for permitting the feed wheel to be shifted to its second position once said tension is removed.

12. A labeller as in claim 11 where said connecting means includes a driver projection which engages in a groove extending obliquely of a surface line of the driving boss so that the feed wheel is shifted to its first position under said tension of the carrier strip.

13. A labeller according to claim 12 wherein said groove extends at an angle of from 10° to 30° obliquely of said surface line of said mounting boss.

14. A labeller according to claim 12 wherein said groove is in the external surface of said driving boss and said driver projection engaging said groove is arranged on the inside wall of said feed wheel.

15. A labeller according to any one of claim 12 through 14 wherein said driving boss has two grooves opposite one another and said feed wheel has two driver projections engaging said grooves.

16. A labeller according to any one of claims 12 through 14 wherein a stop member is arranged at that end of said groove which is further from said second wall.

17. A labeller according to claim 16 wherein said stop member is arranged on a region of said driving boss which has a radially inward springing action.

18. A labeller according to claim 17 wherein said stop member comprises an insertion bevel on the side thereof which is axially external.

19. A labeller as in any one of claims 10, 11 or 12 including a printing member responsive to said hand lever for printing a predetermined label each time the hand lever is actuated.

* * * * *